US009593501B2

(12) United States Patent
Saccoccio et al.

(10) Patent No.: US 9,593,501 B2
(45) Date of Patent: Mar. 14, 2017

(54) REMOVABLE WEIGHT SYSTEM AND METHOD FOR POOL STEPS

(71) Applicant: Asia Connection LLC, New York, NY (US)

(72) Inventors: Mitch Saccoccio, Clarksville, VA (US); Jonathan Bonelli, New York, NY (US)

(73) Assignee: ASIA CONNECTION LLC, New York, NY (US)

( * ) Notice: Subject to any disclaimer, the term of this patent is extended or adjusted under 35 U.S.C. 154(b) by 265 days.

(21) Appl. No.: 14/295,659

(22) Filed: Jun. 4, 2014

(65) Prior Publication Data

US 2015/0000028 A1 Jan. 1, 2015

Related U.S. Application Data

(60) Provisional application No. 61/840,581, filed on Jun. 28, 2013.

(51) Int. Cl.
*E04H 4/14* (2006.01)

(52) U.S. Cl.
CPC ..... *E04H 4/144* (2013.01); *Y10T 29/49826* (2015.01)

(58) Field of Classification Search
CPC ..... E04H 4/144; E04H 4/14; E04G 13/062; E04F 11/02; E04F 2011/0203
USPC ..... 4/496
See application file for complete search history.

(56) References Cited

U.S. PATENT DOCUMENTS 4,599,835 A * 7/1986 Rinke ..... E04H 4/144 52/169.7
5,644,873 A * 7/1997 Bourgault ..... E06C 1/26 52/169.7
6,102,156 A * 8/2000 Lipniarski ..... B29C 49/20 182/115
2008/0169153 A1* 7/2008 O'Connor ..... E06C 9/00 182/93
2010/0170749 A1* 7/2010 Leung ..... E04H 4/144 182/129
2013/0334113 A1* 12/2013 Erlich ..... E04H 4/1209 210/167.1

* cited by examiner

*Primary Examiner* — J. Casimer Jacyna
(74) *Attorney, Agent, or Firm* — Dilworth & Barrese, LLP

(57) ABSTRACT

A weighting system for a swimming pool step assembly includes a pair of weights, a removable cap for each of the weights, and means for removably mounting the weights to the exterior sides of a swimming pool step assembly. The weighting system described herein is easily installed and removed by the user without having to remove the weights from underneath the pool step assembly.

7 Claims, 5 Drawing Sheets

REMOVABLE WEIGHT SYSTEM AND METHOD FOR POOL STEPS

CROSS REFERENCE TO RELATED APPLICATIONS

The present application claims priority to U.S. provisional application No. 61/840,581 filed Jun. 28, 2013, which is herein incorporated by reference.

BACKGROUND

1. Field of the Invention

The present invention relates to a system for weighing down a step assembly for an above ground or in ground swimming pool, and a method for employing same.

2. Background of the Art

Step assemblies for above ground swimming pools are known and commercially available. Step assemblies are often fabricated from a polymeric material. However, because such step assemblies are typically blow molded they tend to be buoyant when installed in the pool water. Accordingly, weighting systems are often provided under the step assembly to maintain stability in the water. Prior known weighting systems are inconvenient because the installation at the beginning of the swimming season and removal at the end of the swimming season requires the user to move the step assembly and/or get under the step assembly to install or remove the weight. Installation and removal of such systems are not only inconvenient, they also pose a risk of injury to the user. What is needed, then, is a simpler weighting system which the user can install to or remove from the outside of a pool step assembly.

SUMMARY

Provided herein is a weighting system for a swimming pool step assembly which comprises at least one, and preferably a pair of weights, a removable cap for each of said weights, and means for removably mounting the weight(s) to the exterior side(s) of a swimming pool step assembly.

The weighting system described herein is easily installed and removed by the user without having to remove the weights from underneath the pool step assembly.

BRIEF DESCRIPTION OF THE DRAWINGS

Various embodiments are described below with reference to the drawings wherein.

DETAILED DESCRIPTION OF PREFERRED EMBODIMENT(S)

Figure 1:
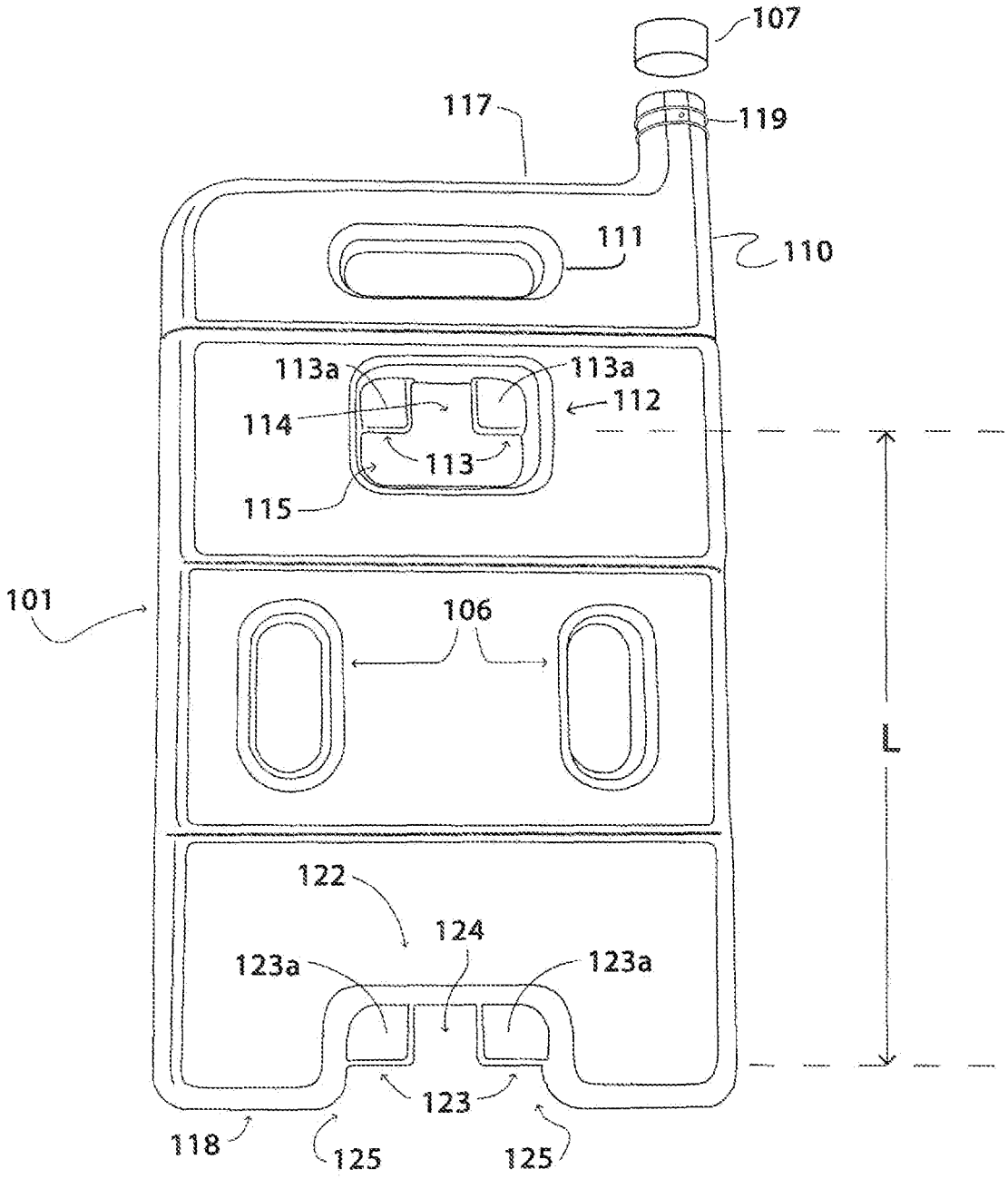
FIG. 1 is an elevational view of a weight of the present invention.
Figure 2:
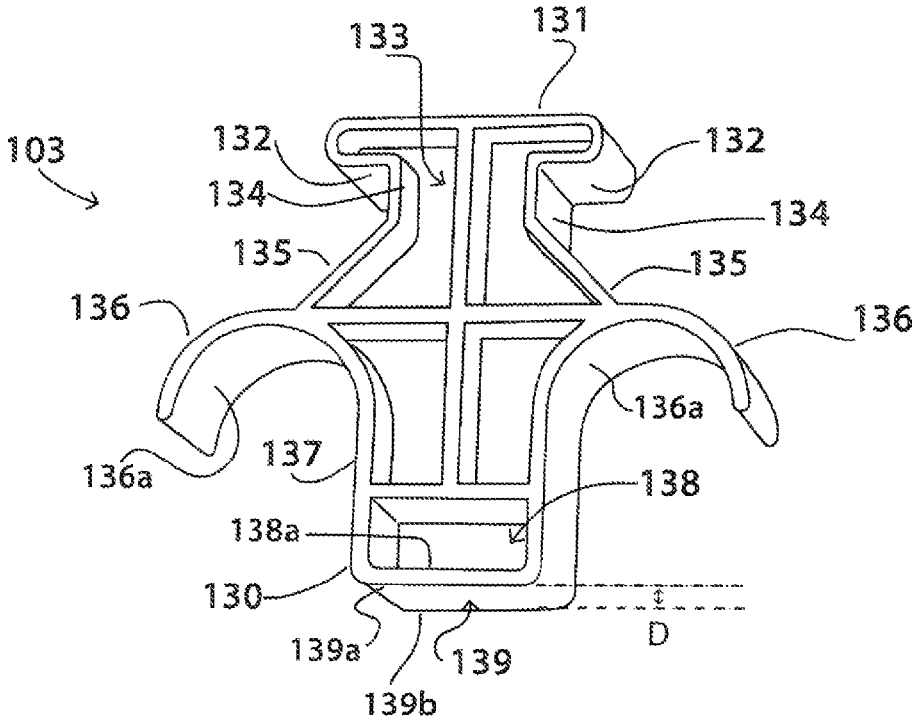
FIG. 2 is a perspective view of a bracket for mounting the weight to a swimming pool step assembly.
Figure 3:
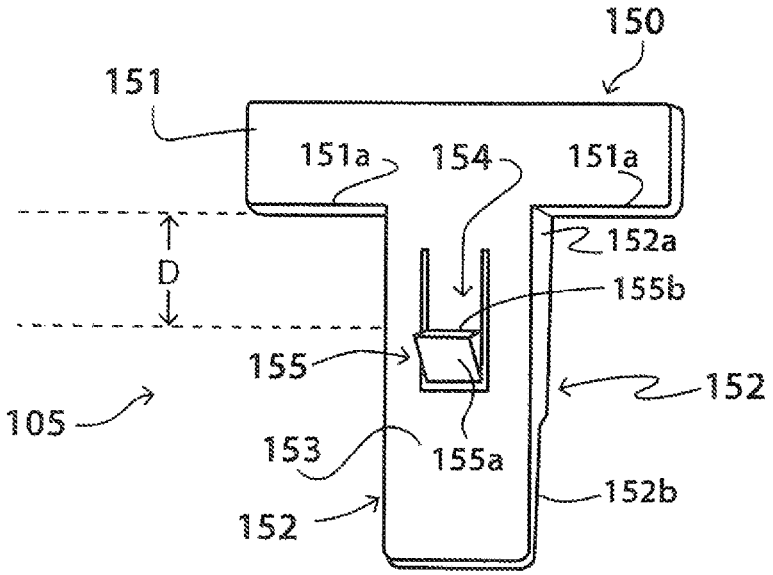
FIG. 3 is a perspective view of a locking member.

Referring to the drawing FIGS. 1 to 3, the removable weight system of the invention includes at least one, and preferably a pair of weights 101, a removable cap 107 for each of the weights, and mounting means for removably mounting the weights to respective exterior sides of the swimming pool step assembly, said mounting means including at least one, and preferably a pair of mounting members 103 and at least one, and preferably a pair of locking members 105 for each weight. The removable weight system of the invention is adapted for mounting to a swimming pool step assembly having a plurality of columns on each side.

More particularly now referring to FIG. 1 each weight 101 comprises a container 110 having a hollow interior space. The container 110 includes an upper end 117 and a lower end 118, an opening 111 the vicinity of the upper end 117 which serves as a handle for carrying the container 110. Below the handle opening 111 an opening 112 is provided for engagement with a mounting member 103, as discussed below. The opening 112 includes two aligned bracket retention plates 113 which are spaced apart so as to define a notch 114. Below notch 114 is a wider space 115 extending across the width of the opening 112. The sides 113*a* of the bracket retention plates 113 provide abutment surfaces for retention of the mounting bracket, as discussed below. The container 110 optionally includes a pair of laterally spaced openings 106. In the vicinity of the bottom end 118 of the container 110 a recess 122 is provided for engagement with a second mounting member 103. Recess 122 includes two bracket retention plates 123 which are spaced apart so as to define a notch 124. Below notch 124 is a wider space 125 extending across the width of the recess 122. The sides 123*a* of the bracket retention plates 123 provide abutment surfaces for retention of the mounting bracket, as discussed below. The bracket retention plates 123 and notch 124 of recess 122 are of the same size and configuration as bracket retention plates 113 and notch 114 of opening 112, wherein the bracket retention plates 123 are spaced apart by distance L from bracket retention plates 113. At the top end 117 of the container 110 a spout 119 is provided and a cap 107 removably engageable with the spout 119 to seal in the contents of the container 110.

Container 110 is preferably made of a synthetic polymeric resin such as polyvinyl chloride (PVC), acrylonitrile-butadiene-styrene polymer (ABS), or other suitable polymers and is fabricated by any suitable method as known in the art. To be used as a weight, container 110 is filled with sand or other particulate material having a density greater than water and then capped, as discussed below.

Referring to FIG. 2, the a mounting member 103 preferably comprises a bracket 130 integrally formed as a single piece from a rib network structure 133. Mounting bracket 130 has an upper (as shown) head portion 131 with an opposite facing abutment surface 132 which is adapted to abut the abutment surface 113*a* or 123*a* of the bracket retention plates 113 and 123 when the weight system of the invention is fully installed. Mounting bracket 130 includes an upper longitudinal neck portion 134, an angled portion 135 and oppositely extending C-shaped wings 136, each having a respective concave abutment surface 136*a*. The wing portions 136 are configured and dimensioned so as to engage the narrower portions 192*b* of columns 192, as discussed below. The lower (as shown) portion 137 of the member 130 includes an opening 138 configured and dimensioned so as to receive therethrough the spine 152 of a locking member 105, as discussed below, and an end wall 139 at least partially defined by opposite edges 139*a* and 139*b*. The distance D between edges 139*a* and 139*b* defines a width of the end wall 139. Opening 138 is defined by an interior wall surface and is at least partially defined by an interior abutment surface 138*a* of the interior wall which abuts the abutment surface 153 of the locking T-shaped bracket 150 when the locking member 105 is fully engaged in opening 138, as discussed below.

Referring to FIG. 3, the locking member 105 preferably comprises an integral single piece T-shaped locking bracket 150 having an upper lateral arm 151 with lower edge 151*a*. The vertical spine 152 extending downward (as shown) from the lateral arm 151 includes a relatively thicker upper portion 152*a* and a relatively thinner lower portion 152*b*. The difference in thickness facilitates the insertion of the spine 152 into the end portion opening 138 of the mounting bracket 130, as discussed below. Spine 152 has a planar abutment surface 153 which abuts the abutment surface 138*a* of the opening 138. On spine 152 locking bracket 150 includes a resilient snap lock 154 having a latch 155 possessing an inclined surface 155*a* and an abutment edge 155*b* which is adapted to abut edge 139*b* of end wall 139 when the locking bracket is fully inserted into the opening 138 to prevent unintended disengagement. The latch 155 is pressed inwardly as the edge 139*a* cams against inclined surface 155*a* as the spine 152 is inserted into opening 138. The distance between lower edge 151*a* of the lateral arm 151 and the upward facing abutment edge 155*b* is the same distance D as that between edges 139*a* and 139*b* of the end wall 139.

A method for installing the removable weight system of the invention will now be described. In an exemplary method two weight containers 110 are provided. Into each is first poured a quantity of water (i.e., about 10 ounces of water). Then sand or other particulate material denser than water is poured through spout 119 until the container is full and water runs out of the spout 110. This insures that there is no air in the container 110. A cap 107 is applied to the spout of each container to seal the contents of the container.

Figure 4:
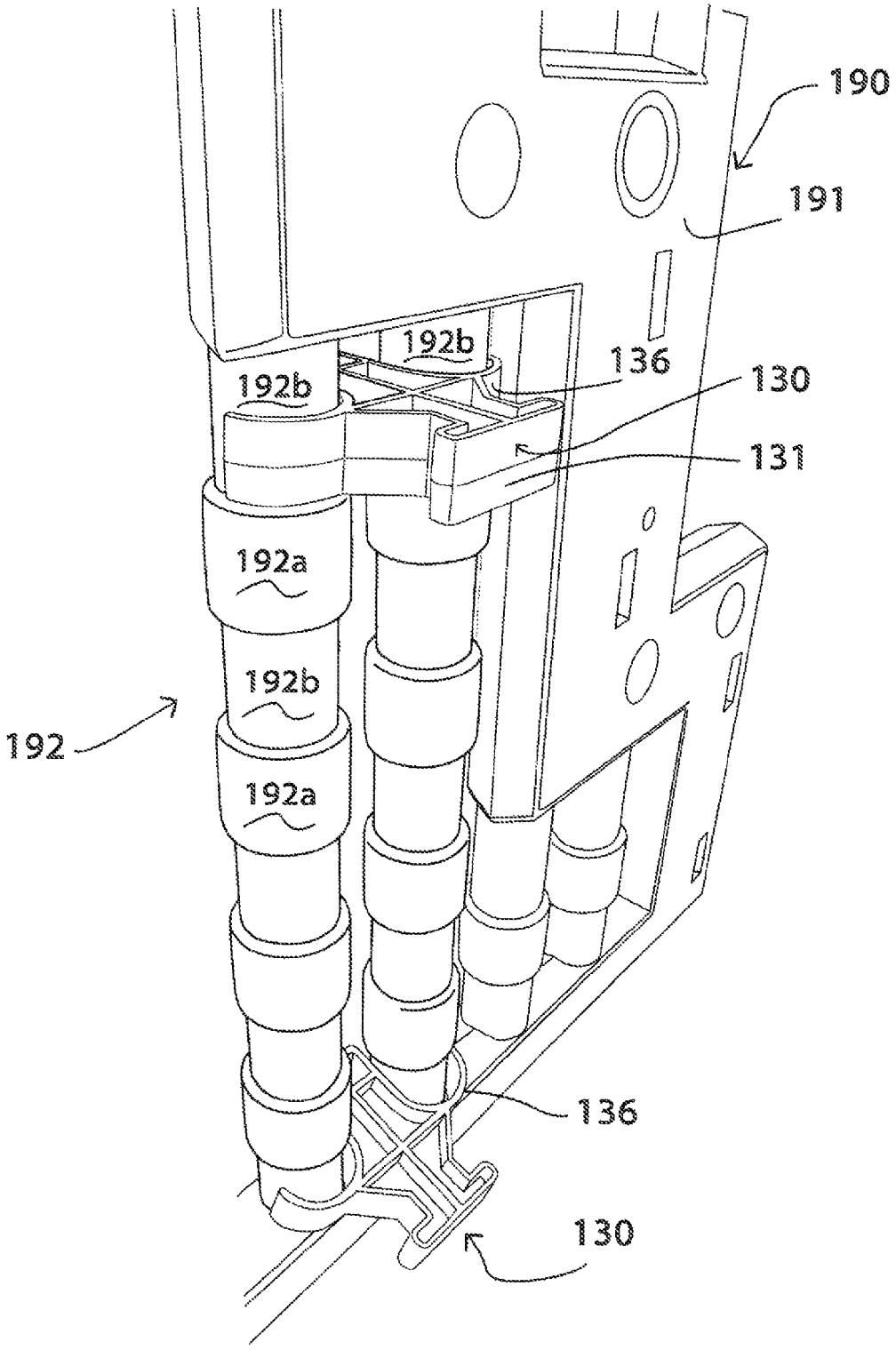
FIG. 4 illustrates the engagement of the mounting bracket with the columns of a swimming pool step assembly.

Referring to FIG. 4, the pool step assembly 190 includes parallel vertical columns 192, each having a plurality of alternating wide diameter portions 192*a* and narrow diameter portions 192*b*. On each side of the step assembly a first mounting bracket 130 is attached between two adjacent columns by engaging the to C-shaped wings 136 with a respective column 192 at an upper portion of said columns such that the concave abutment surface 136*a* of each wing 136 contacts the narrow diameter portion 192*b* of the respective column. A second mounting bracket 130 is similarly mounted to a lower portion of the adjacent columns. The head portion 131 faces outwardly of the side of the pool step assembly. The end wall 139 and opening 138 protrude to the opposite, inner side of the pool step assembly. The distance between the upper mounting bracket 130 and the lower mounting bracket 130 must equal the distance L between the bracket retention plates of the container 110.

Figure 5:
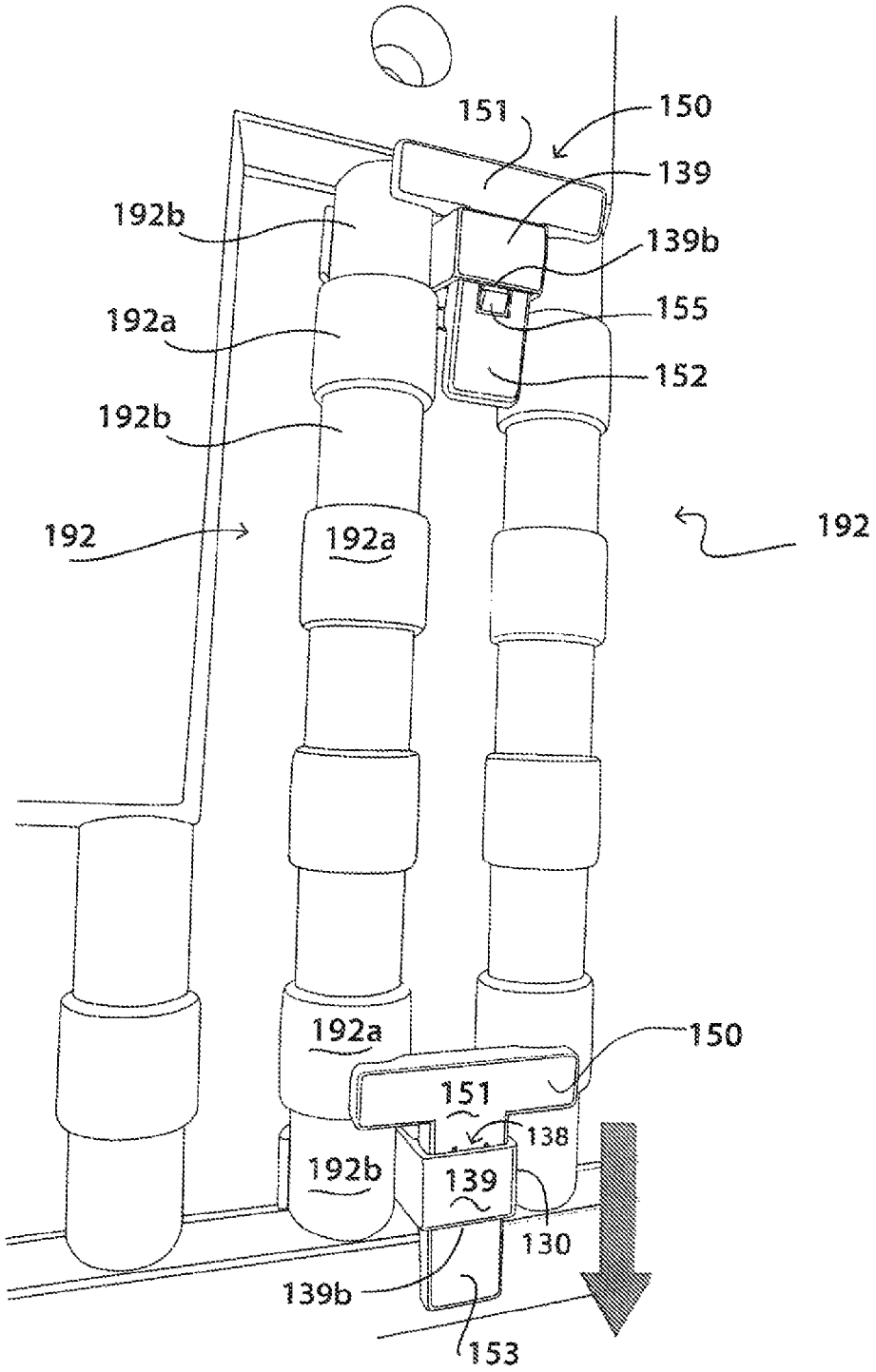
FIG. 5 illustrates the engagement of the locking member with the mounting bracket.

Next as shown in FIG. 5, a respective T-shape locking bracket 150 is engaged with each of the mounting brackets 130 by inserting the vertical spine 152 through opening 138 of the mounting bracket 130. To obtain complete insertion of the locking member 105, the T-shaped locking bracket 150 must be pushed downward as shown by the arrow until the latch 155, pressed inwardly during partial insertion, springs back outward. As the distance D between the lower edge 151*a* of the lateral and the upward facing abutment edge 155*b* is equal to the distance D between edges 139*a* and 139*b* of the end wall 139, when full insertion is achieved, the edge 155*b* abuts the edge 139*b* of the mounting bracket 130 to prevent unintended disengagement of the T-shaped locking bracket 150. However, the user may intentionally disengage the locking bracket 150 by manually pressing surface 155*a* of the latch 155 such that there is no longer abutment between edges 155*b* and 139*b*.

Figure 6:
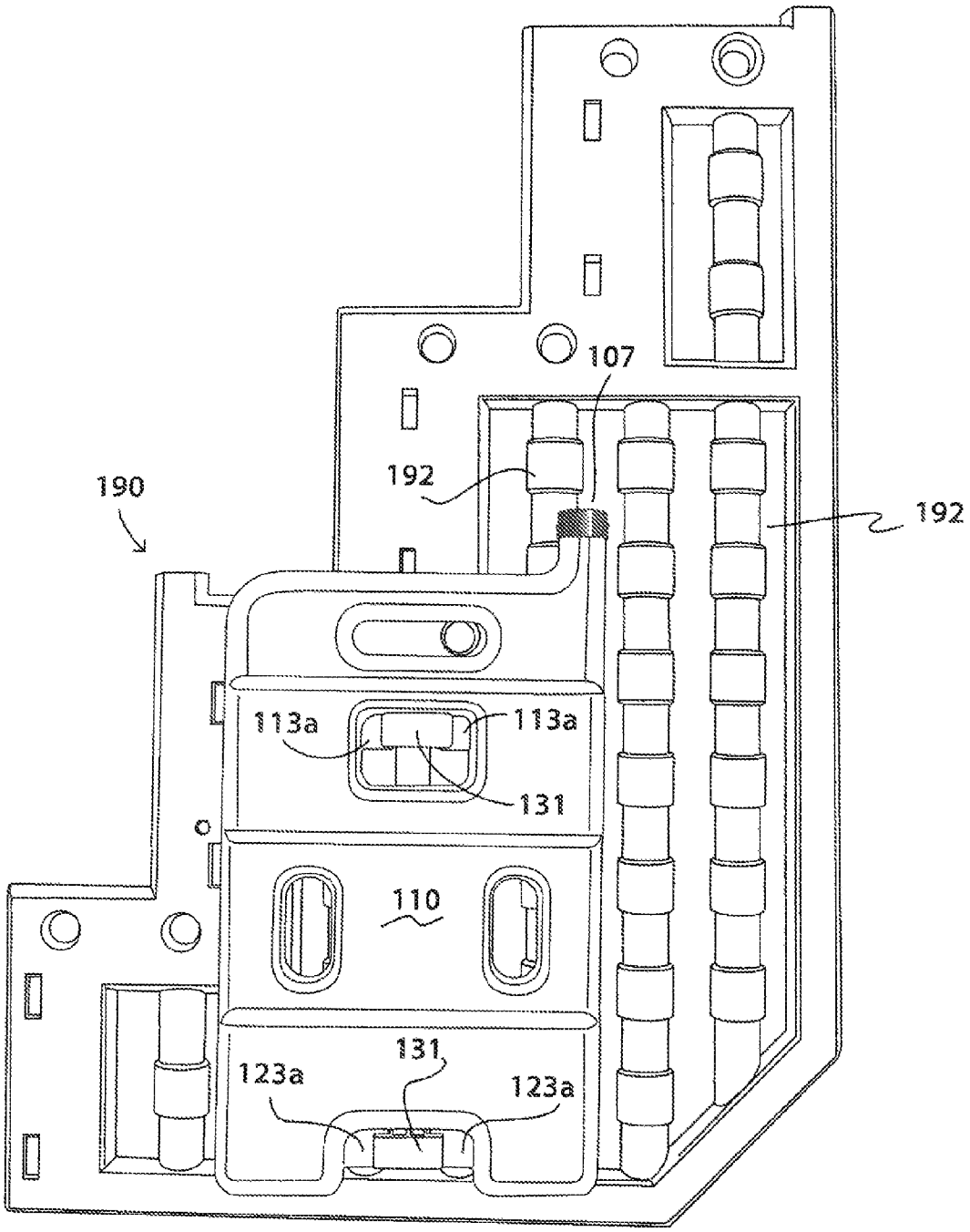
FIG. 6 is an elevational view illustrating the mounting of the weight to the exterior side of the swimming pool step assembly.

Next, referring now to FIG. 6, a weight container 110 is mounted to the upper and lower mounting members 130 by orienting the weighted container 110 such that the spout 109 faces towards the pool wall. The container 100 is then placed on the mounting brackets 130 such that the head portions 131 extend through respective spaces 115 and 125. The container 110 is then pushed downward such that longitudinal neck portions 134 of the mounting brackets 130 are disposed respectively through the notches 114 and 124, and the bracket retention plates 113 and 123 abut the abutment surfaces 132 of the respective mounting brackets 130. The procedure is repeated for the second container 110 on the opposite side of the pool step assembly 190. At the end of the season the procedure is reversed to disassemble the weight system.

While the above description contains many specifics, these specifics should not be construed as limitations of the invention, but merely as exemplifications of preferred embodiments thereof. For example, although the weight system of the invention has been described in terms of two weight containers and two mounting brackets and two locking members for each weight, a weight system comprising only a single weight container with a single mounting bracket and locking bracket is to be considered within the scope of the present invention. Those skilled in the art will envision many other embodiments within the scope and spirit of the invention as defined by the claims appended hereto.

What is claimed is:

1. A weight system for a swimming pool step assembly which comprises:

a) at least one weight, wherein each one of the at least one weight includes a hollow interior space, and the hollow interior space includes a pair of bracket retention plates which are spaced apart so as to define a notch therebetween;

b) at least one mounting bracket to removably mount the weight to the swimming pool step assembly; and wherein the mounting bracket includes a head portion and a neck portion, the neck portion being configured and dimensioned so as to be engaged in the notch of the at least one weight such that abutement surfaces of the head portion contact respective abutement surfaces on the bracket retention plates.

2. The weight system of claim 1 further comprising at least one locking bracket configured and dimensioned so as to engage the mounting bracket.

3. The weight system of claim 1 wherein the mounting bracket includes oppositely extending C-shaped wing portions and an opening at an end portion opposite that of the head portion.

4. The weight system of claim 3 wherein the locking bracket is T-shaped with a lateral branch and vertical spine, said spine being configured and dimensional so as to be received into the opening at the end portion of the mounting bracket.

5. The weight system of claim 4 wherein the spine of the locking bracket possesses a resilient snap lock.

6. In combination with a swimming pool step assembly having a plurality of parallel spaced apart vertical columns on each of two opposite sides, the weight system of claim 1, wherein said at least one weight comprises at least two weights and said at least one mounting bracket comprises at least two mounting brackets and at least two locking brackets for each weight, each weight comprising a container having at least two pairs of bracket retention plates in spaced vertical alignment.

7. In combination with a swimming pool step assembly having a plurality of parallel spaced apart vertical columns, the weight system of claim 5.

* * * * *